US008439056B2

(12) United States Patent
Shyu

(10) Patent No.: US 8,439,056 B2
(45) Date of Patent: May 14, 2013

(54) STICK ALLOWING AN UMBRELLA TO BE INSTALLED THEREIN

(76) Inventor: Shing Hae Shyu, Toufen Township (TW)

( * ) Notice: Subject to any disclaimer, the term of this patent is extended or adjusted under 35 U.S.C. 154(b) by 29 days.

(21) Appl. No.: 13/340,807

(22) Filed: Dec. 30, 2011

(65) Prior Publication Data

US 2012/0204919 A1 Aug. 16, 2012

(30) Foreign Application Priority Data

Feb. 14, 2011 (CN) ..... 2011 2 0038191 U

(51) Int. Cl.
*A45B 21/00* (2006.01)

(52) U.S. Cl.
USPC ..... 135/17; 135/18; 135/34.2; 135/76

(58) Field of Classification Search ..... 135/17, 135/18, 19, 34.2, 66, 76; 403/109.2, 109.3, 403/109.6
See application file for complete search history.

(56) References Cited

U.S. PATENT DOCUMENTS

| | | | | | |
|---|---|---|---|---|---|
| 168,092 | A * | 9/1875 | Harris et al. | 135/19 |
| 563,863 | A * | 7/1896 | Lloyd | 135/18 |
| 629,460 | A * | 7/1899 | Nagell | 135/19 |
| 919,567 | A * | 4/1909 | Genck | 135/18 |
| 2,266,684 | A * | 12/1941 | Brown | 135/16 |
| 4,288,102 | A * | 9/1981 | Ramer | 280/823 |
| 6,223,759 | B1 * | 5/2001 | Flippin, Jr. | 135/34.2 |
| 6,334,454 | B1 * | 1/2002 | Williams | 135/25.41 |
| 6,435,754 | B1 * | 8/2002 | Canale | 403/109.2 |
| 2009/0159106 | A1 * | 6/2009 | Schulz et al. | 135/75 |

* cited by examiner

*Primary Examiner* — Noah Chandler Hawk

(74) *Attorney, Agent, or Firm* — Ming Chow; Sinorica, LLC

(57) ABSTRACT

An easily detachable stick has an umbrella installed therein. The stick includes a grip element having a root portion extending therefrom, the root portion having a platform along an axis direction and a leaf spring installed on the platform, the leaf spring having one end fixed to the platform and the other end being a free end; and a supporting pole having a hollow cavity installed therein, the cavity having an opening at one end thereof, into which the root portion is inserted, a sliding groove disposed in the opening along an axis direction of the cavity, a sliding button embedded in the sliding groove, an elastic element installed in the sliding groove between the sliding button and the opening of the cavity, and an inner flange inward protruding from the opening of the cavity, allowing the free end of the leaf spring to be supported by the inner flange.

18 Claims, 7 Drawing Sheets

STICK ALLOWING AN UMBRELLA TO BE INSTALLED THEREIN

BACKGROUND OF THE INVENTION

1. Field of the Invention

This invention relates to sticks, and, more particularly, to an easily-detachable stick allowing an umbrella to be installed therein.

2. Description of Related Art

US2008/0087310, entitled "WALKING STICK UMBRELLA," disclosed in FIG. 1 a stick combined with an umbrella, wherein a shaft serves as a stick pole of the stick, and a grip element of the umbrella serves as a handle of the stick. However, the walking stick umbrella has the following drawbacks:

1. when the umbrella is in use, a user, especially a senior citizen, that needs to use the stick cannot use the stick at the same time;

2. the stick is not retractable, and is not suitable for both tall and short users; and 3. the umbrella is exposed to a region outside of the stick, and is likely to be damaged.

A stick having a large cross section came to the market. The stick has a handle and a stick pole that is screwed to the handle. After the handle is screwed off the stick pole, an umbrella may be received in a cavity of the stick pole that also has a large cross section. Since not designed exclusively for the stick, the umbrella cannot be smoothly received in cavity of the stick pole. Moreover, the user is daunted by the tedious operations of screwing the stick pole off the handle, inserting the umbrella into the cavity of the stick poly, and screwing the stick pole back. Further, the stick is not retractable and is too heavy to carry.

SUMMARY OF THE INVENTION

In view of the above-mentioned drawbacks of the prior art, it is a primary objective of the present invention to provide an easily detachable stick allowing an umbrella to be installed therein. The stick has a grip element and a supporting pole that is easily fixed to and detachable from the grip element, allowing a user to take the umbrella out of a cavity of the supporting pole in which the umbrella is received and use the umbrella and the stick at the same time. Since received in the cavity of the supporting pole, the umbrella is protected from damages. Further, the stick is retractable.

To achieve the above-mentioned and other objectives, an easily-detachable stick allowing an umbrella to be installed therein is provided according to the present invention, including:

a grip element having a root portion extending therefrom, the root portion having a platform along an axis direction and a leaf spring installed on the platform, the leaf spring having one end fixed to the platform and the other end being a free end; and a supporting pole having a hollow cavity installed therein, the cavity having an opening at one end thereof, into which the root portion is inserted, a sliding groove disposed in the opening along an axis direction of the cavity, a sliding button embedded in the sliding groove, an elastic element installed in the sliding groove between the sliding button and the opening of the cavity, and an inner flange inward protruding from the opening of the cavity, allowing the free end of the leaf spring to be supported by the inner flange.

In an embodiment of the present invention, a protrusion is disposed on the root portion, a groove is disposed on an inner side of the opening of the cavity and corresponds in position to the protrusion for the protrusion to be combined therewith, and the leaf spring corresponds in position to the sliding button.

In another embodiment of the present invention, the supporting pole is retractable, and the supporting pole has a plurality of retractable skeleton segments, one of which has a plurality of locking holes disposed thereon, and another of which has a depressible latch that matches with any one of the locking holes.

In yet another embodiment of the present invention, the umbrella is a foldable umbrella that comprises a rib, a shaft, a handle having a tip cup connected to the shaft, a runner movable along the shaft and hinged on a side of the rib, and a canopy combined with one end of the rib and one end of the shaft.

Preferably, the end of the rib can be received in the tip cup and enclose the shaft tightly, without enclosing a periphery of the runner, and the runner, together with the end of the rib, can be received in the tip cup of the handle. By contrast, the conventional umbrella has too large a cross section for the umbrella to be received in the stick pole because the rib still encloses the runner after the retraction of the umbrella. Therefore, the umbrella, after retracted, is very slim, and is easily received in the stick because the runner is received in the shaft.

The present invention provides an easy operation of fixing/detaching the grip element to/from the supporting pole. Moreover, a user may use the umbrella and the stick at the same time.

The invention can be more fully understood by reading the following detailed description of the preferred embodiments, with reference made to the accompanying drawings.

DETAILED DESCRIPTION OF THE INVENTION

Figure 1:
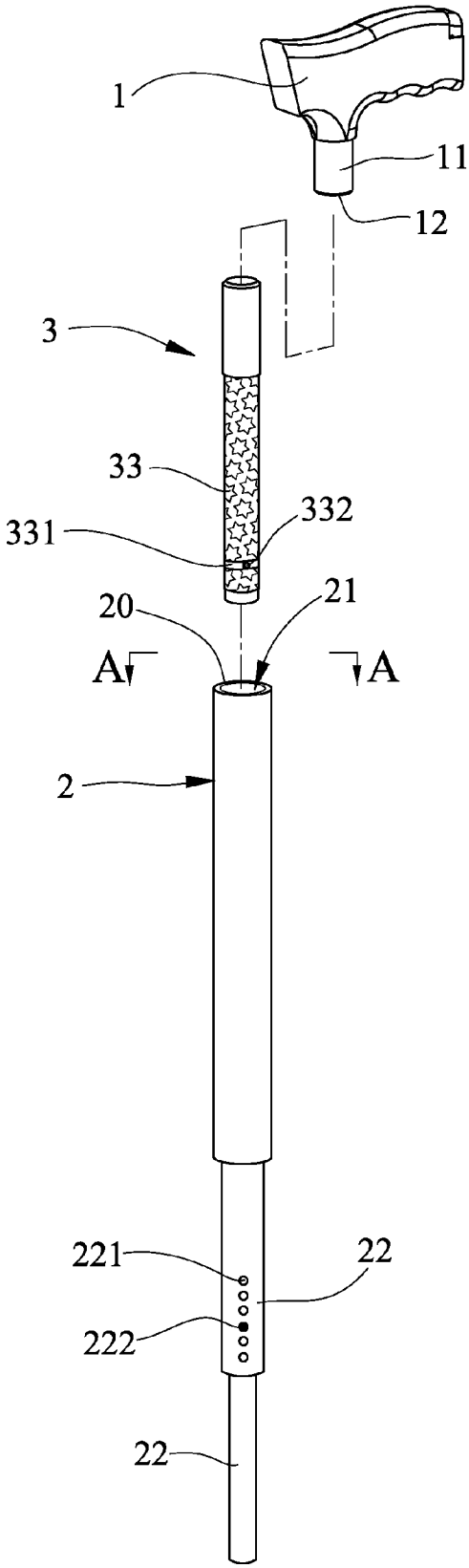
FIG. 1 is an exploded view of an easily-detachable stick allowing an umbrella to be installed therein according to the present invention.

Please refer to FIG. 1, which shows an exploded view of an easily-detachable stick allowing an umbrella to be installed therein. The stick comprises a grip element 1 having a root portion 11 extending therefrom, the root portion 11 having a platform 111 along an axis direction and a leaf spring 112 installed on the platform 111, the leaf spring 112 having one end fixed to the platform 111 and the other end being a free end; and a supporting pole 2 having a hollow cavity 21 installed therein, the cavity 21 having an opening 20 at one end thereof, into which the root portion 11 is inserted, a sliding groove 211 disposed in the opening 20 along an axis direction of the cavity 21, a sliding button 212 embedded in the sliding groove 211, an elastic element 213 installed in the sliding groove 211 between the sliding button 212 and the opening 20 of the cavity 21, and an inner flange 24 inward protruding from the opening 20 of the cavity 21, allowing the free end of the leaf spring 112 to be supported by the inner flange 24.

The grip element 1 has an integral structure. The root portion 11 is extended and protruded downward from the grip element 1. The end of the root portion 11 has a round or any other shape of cross section. In an embodiment of the present invention, the end of the root portion 11 has a round cross section.

The supporting pole 2 has the hollow cavity 21 installed therein. The cavity 21 may have a round or any other shape of cross section that corresponds to the cross section of the end of the root portion 11. In an embodiment of the present invention, the end of the grip element 1 has a round cross section. The top end of the supporting pole 2 is fixed to the root portion 11 of the grip element 1. The cavity 21 is used for reception of an umbrella.

The supporting pole 2 is retractable, and has a plurality of retractable skeleton segments 22, one of which has a plurality of locking holes 221 disposed thereon, and another of which adjacent the one of the retractable skeleton segments 22 has a latch 222 disposed thereon. The latch 222 may be depressed and bounded back, and matches with any one of the locking holes 221. Therefore, the stick has a variety of lengths, and is suitable for both tall or short users.

Figure 2:
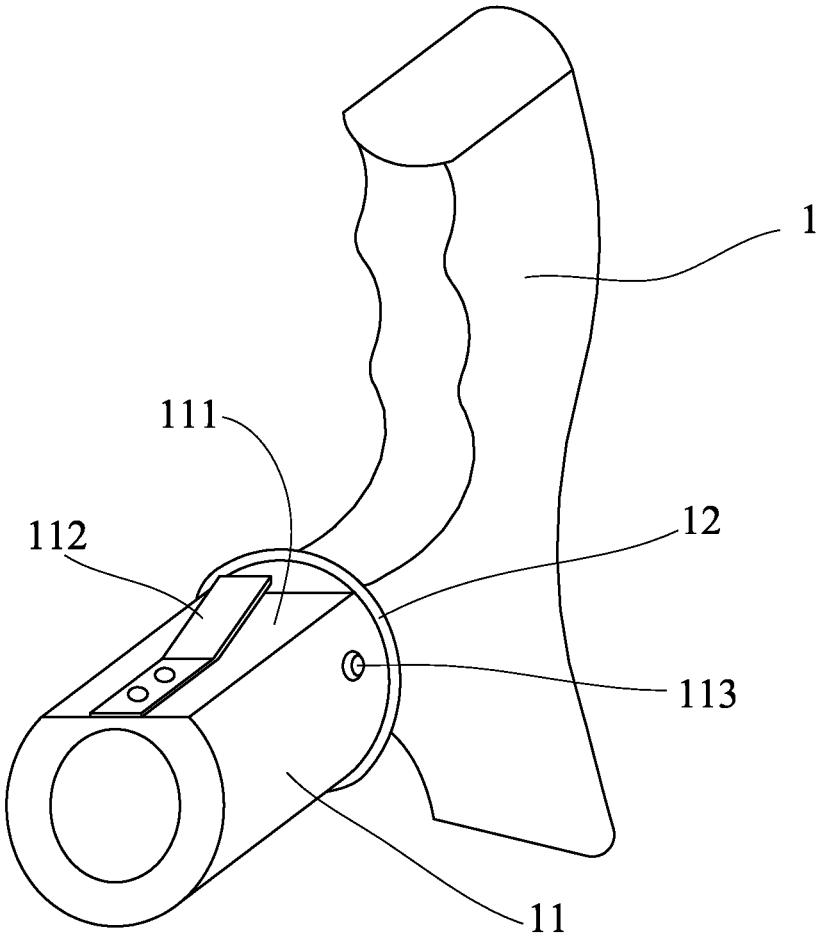
FIG. 2 is a schematic diagram of a root portion of a grip element of the stick.
Figure 3:
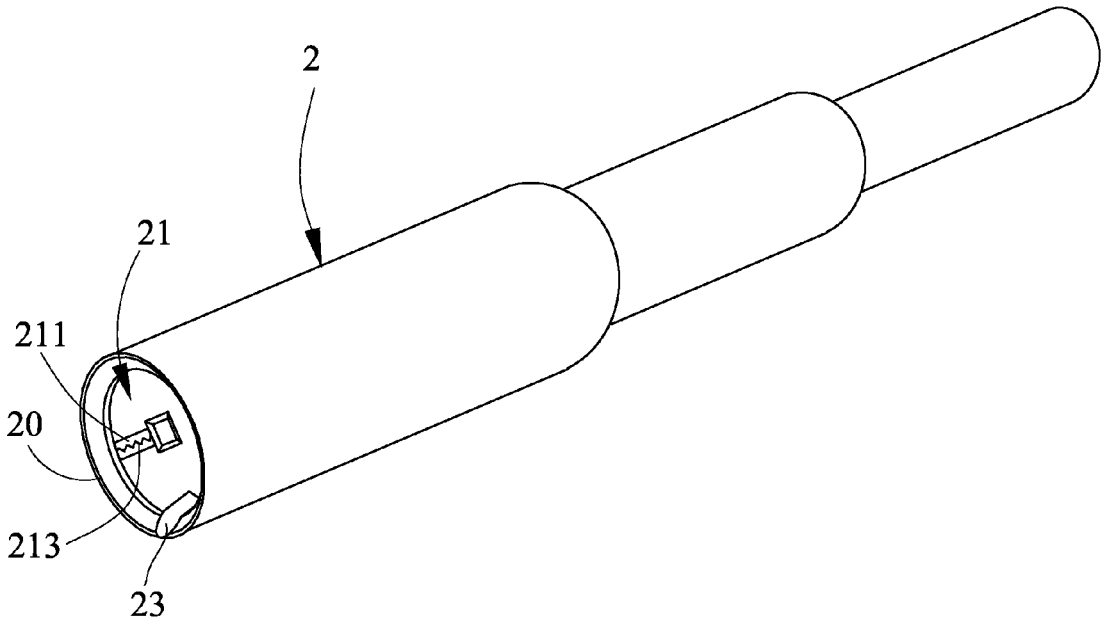
FIG. 3 is a schematic diagram of a supporting pole of the stick.

Please refer to FIG. 2, which is a schematic diagram of the root portion 11 of the grip element 1. The root portion 11 has the platform 111 along the axis line, and the leaf spring 112 disposed on the platform 111. The leaf spring 112 has one end fixed to the platform 111, and the other end being a free end that is warped upward in a normal state. In an embodiment of the present invention, the leaf spring 112 is fixed to the platform 111 by screws or rivets. A protrusion 113 is disposed on the root portion 11, at an angle with respect to the platform 111. A seal ring 12 is disposed at a connection of the root portion 11 with the grip element 1. When the grip element 1 is connected to the supporting pole 2, the seal ring 12 ensures that no rain or dust may enter the cavity 21 of the supporting pole 2.

Figure 4:
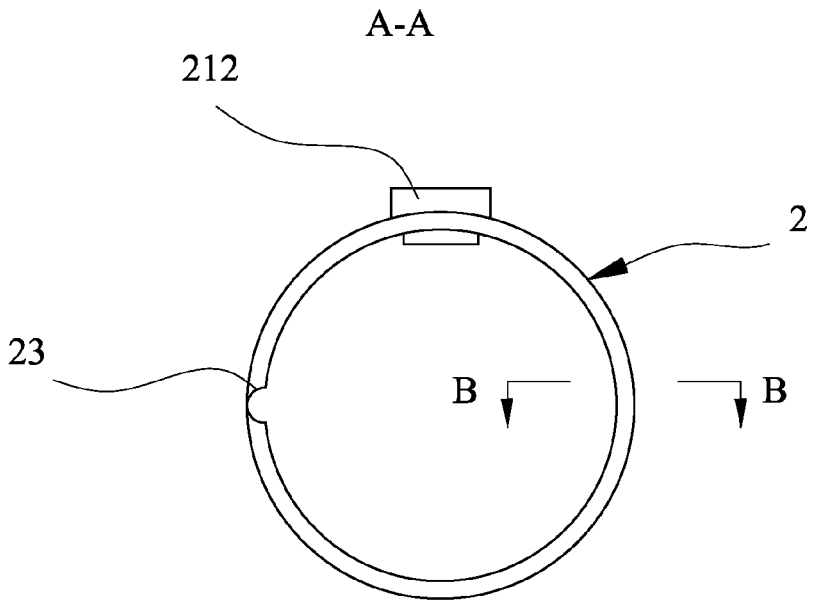
FIG. 4 is a cross-section view of FIG. 1 along a cutting line A-A.
Figure 5:
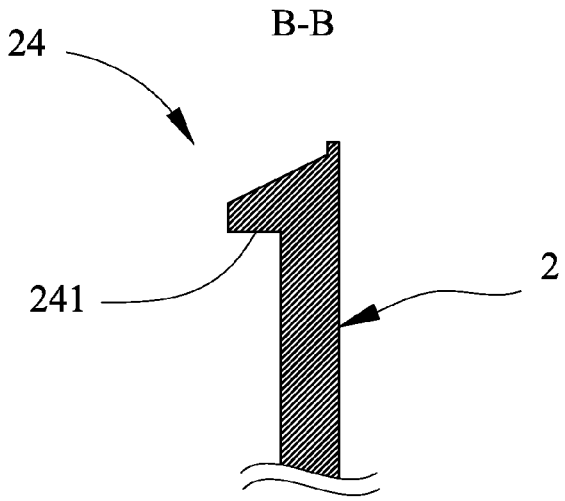
FIG. 5 is a cross-section view of FIG. 4 along a cutting line B-B.
Figure 6:
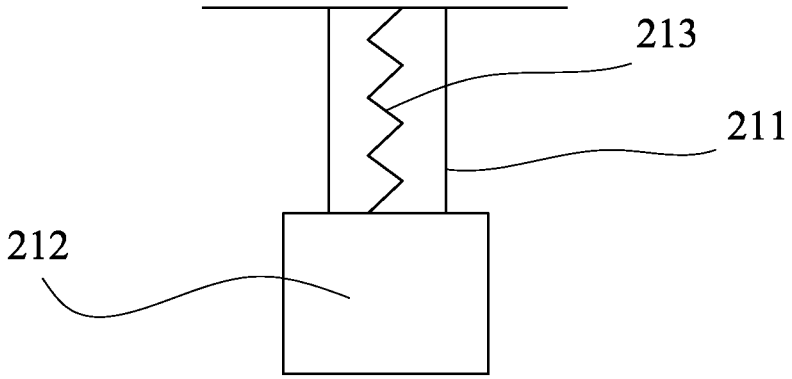
FIG. 6 is a schematic diagram of an elastic element of the stick in a stretching state.
Figure 7:
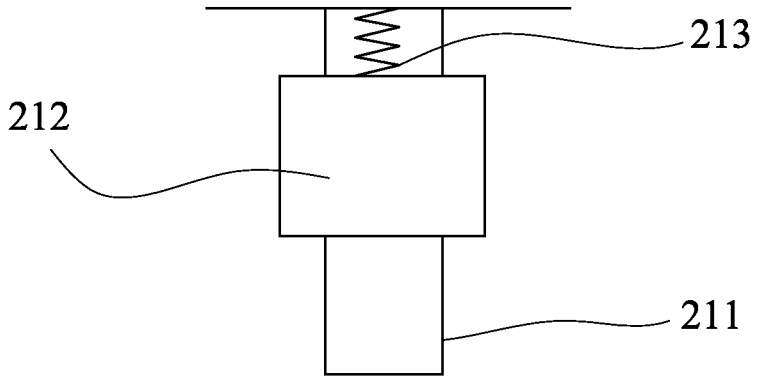
FIG. 7 is a schematic diagram of the elastic element in a compressing state.

Please refer to FIGS. 3-7, which are a schematic diagram of a supporting pole of the stick, a cross-section view of FIG. 1 along a cutting line A-A, a cross-section view of FIG. 4 along a cutting line B-B, a schematic diagram of an elastic element of the stick in a stretching state, and a schematic diagram of the elastic element in a compressing state, respectively. The cavity 21 of the supporting pole 2 has the opening 20 disposed on one end thereof. The sliding groove 211 is disposed along the axis direction of the cavity 21. The sliding button 212 is embedded in the sliding groove 211. An elastic element 213 is installed between the sliding button 212 and the opening 20 of the cavity 21. In an embodiment of the present invention, the elastic element 213 is an elastic element. A groove 23 is formed on an inner side of the opening 20 of the cavity 21, and is also at the predetermined angle with respect to the sliding groove 211. When the leaf spring 112 corresponds in position to the sliding button 212, the protrusion 113 of the root portion 11 also corresponds in position to the groove 23. Additionally, an inner flange 24 inward protrudes from the opening 20 of the cavity 21, allowing the free end of the leaf spring 112 to be supported thereby. In an embodiment of the present invention, the inner flange 24 is conical, and has a narrower opening toward an inner direction of the cavity 21. The conical surface of the inner flange 24 has an edge planer positioning function. Accordingly, when the root portion 11 combines with the opening 20 and the protrusion 113 combines with the groove 23, the protrusion 113 slides by using the conical surface of the inner flange 24, to search for the groove 23 and achieve a fool-proof design.

When the grip element 1 needs to be connected to the supporting pole 2, the protrusion 113 of the root portion 11 is aligned with the groove 23 of the supporting pole 2, allowing the root portion 11 of the grip element 1 to be inserted into cavity 21. At the same time, the free end of the leaf spring 112 is supported by an inner wall of the inner flange 24, such that the grip element 1 is fixed to the supporting pole 2. Since the elastic element 213 is in a stretching state, it is ensured that the sliding button 212 does not press the free end of the leaf spring 112, and the grip element 1 will not be detached from supporting pole 2 accidentally.

Please refer to FIG. 1 again, which shows that the supporting pole 2 combines with an umbrella 3 that is received in the cavity 21.

Figure 8:
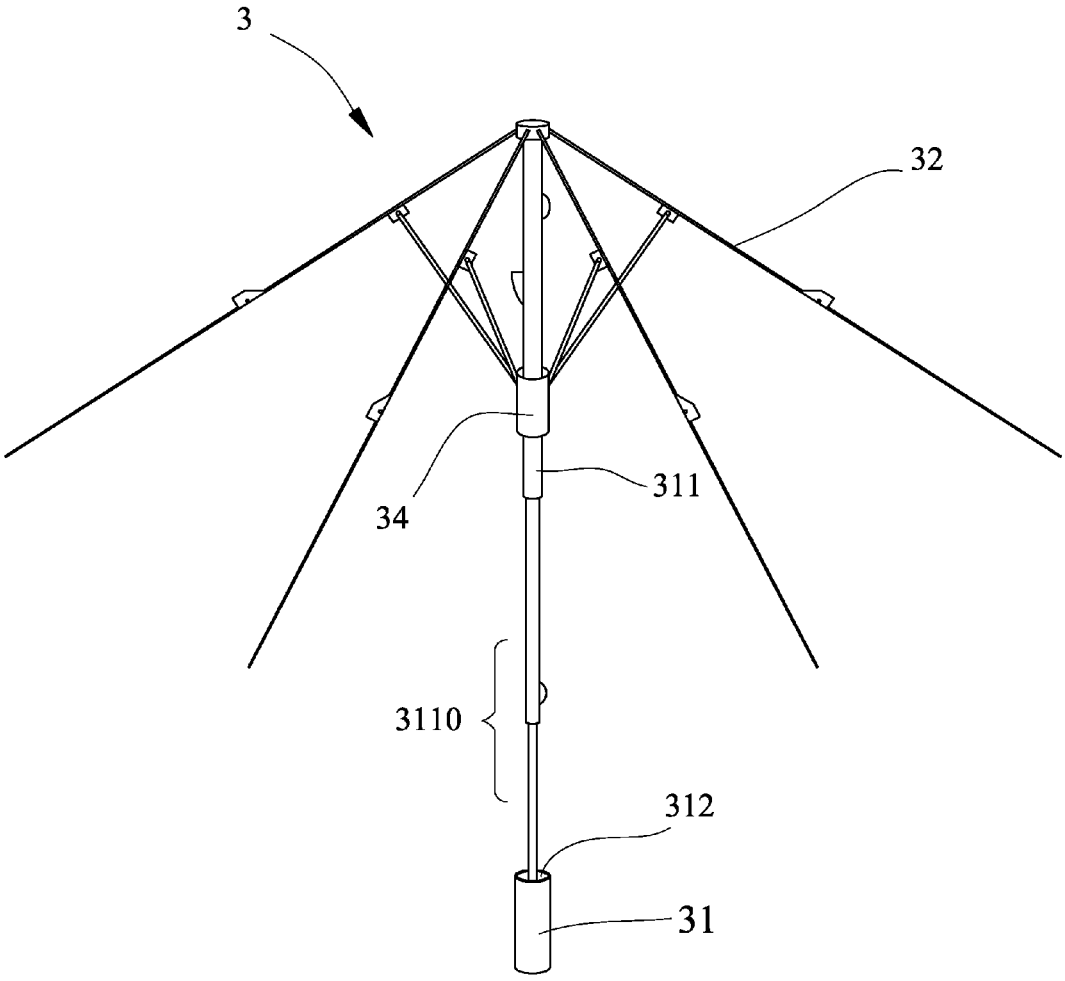
FIG. 8 is a schematic diagram of an umbrella (without a canopy) that is installable in the stick.
Figure 9:
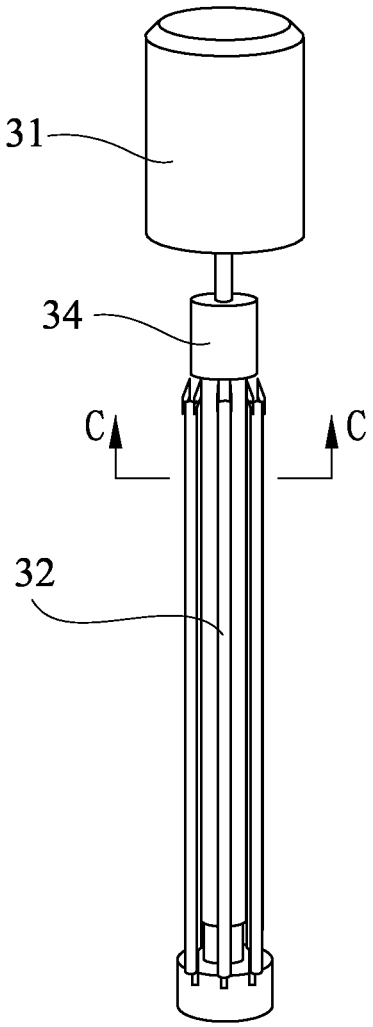
FIG. 9 is a schematic diagram of the umbrella that is retracted, with a runner of the umbrella not received in a tip cup of a handle of the stick.
Figure 10:
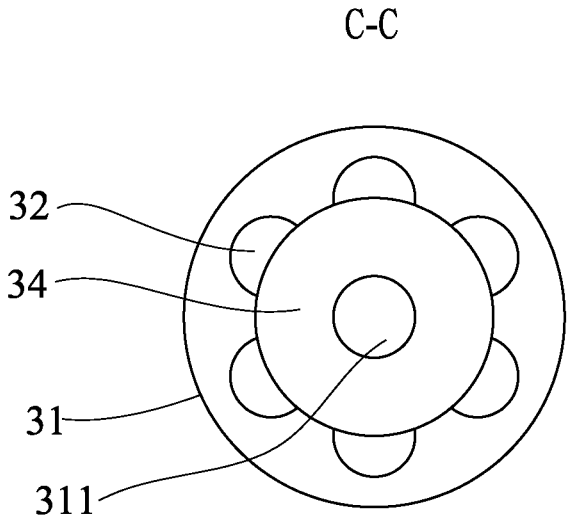
FIG. 10 is a cross-section view of FIG. 9 along a cutting line C-C.

In an embodiment of the present invention, the umbrella is a foldable umbrella. Please refer to FIGS. 8-10, which are a schematic diagram of the umbrella (without a canopy), a schematic diagram of the umbrella that is retracted, with a runner of the umbrella not received in a tip cup of a handle of the stick, and a cross-section view of FIG. 9 along a cutting line C-C.

The umbrella 3 comprises a rib 32, a shaft 311, a handle 31 having a tip cup 312 connected to the shaft 311, a runner 34 movable along the shaft 311 and hinged on a side of the rib 32, and a canopy 33 combined with one end of the rib 32 and one end of the shaft 311, allowing the end of the rib 32, after retracted, to be received in the tip cup 312 and enclose the shaft 311 tightly, without enclosing a periphery of the runner 34. The other side of shaft 311 is retractable, allowing the end of the rib 32, after retracted, to be received in the tip cup 312 easily, and preventing the loose of the rib 32. The runner 34 is hinged to one side of the rib 32, so the rib 32, after retracted, encloses the shaft 311 tightly, without enclosing a periphery of the runner 34. By contrast, the rib of the conventional umbrella, after retracted, encloses a periphery of the runner 34 and is slightly wide-open. Therefore, the umbrella 3, after the rib 32 is retracted, is slimmer. In an embodiment of the present invention, the shaft 311 comprises a plurality of retractable segments 3110 having cross sections decreasing toward the handle 31 gradually, allowing one of the retractable segments 3110 having a smallest cross section to be received in the tip cup 312 of the handle 31, such that the end of the rib 32 and the runner 34 of the umbrella 3 are receivable in the tip cup 312 because the retractable segment 3110 that has the smallest cross section occupies a small space in the tip cup 312 and a sidewall of the tip cup 312 defines a large space in the tip cup 312.

Please refer to FIGS. 2 and 4 at the same time. When the umbrella 3 is taken out of the cavity 21 and the sliding button 212 moves along the sliding groove 211 to the opening 20 of the cavity 21, the elastic element 213 is in a compressing state and the sliding button 212 compresses the free end of the leaf spring 112, such that the free end is in contact with the platform 111 and the grip element 1 can be detached from the supporting pole 2.

The canopy 33 is installed on and connected to the rib 32. A binding lace 331 is disposed on the canopy 33. The binding lace 331 has one end connected to the canopy 32, and the other end connected to a binding device 332. The binding lace 331 is long enough to enclose and bind the canopy 33 that is retracted, and the canopy 33 is fixed to the binding lace 331 by the binding device 331. Therefore, the retracted canopy 33 will not be loosed. In an embodiment of the present invention, the binding device 332 is a buckle or a Velcro.

In sum, the stick of the present invention provides an easy operation of fixing/detaching the grip element to/from the supporting pole. Moreover, an umbrella may be received in the cavity of the supporting pole. Accordingly, a user may use the umbrella and the stick at the same time. The umbrella, since received in the cavity of the supporting pole, is protected from potential damages. The stick of the present invention is retractable. A user is allowed to use the umbrella and the stick at the same time, no matter what the weather is.

The foregoing descriptions of the detailed embodiments are only illustrated to disclose the features and functions of the present invention and not restrictive of the scope of the present invention. It should be understood to those in the art that all modifications and variations according to the spirit and principle in the disclosure of the present invention should fall within the scope of the appended claims.

What is claimed is:

1. A stick allowing an umbrella to be installed therein, the stick comprising:

a grip element having a root portion extending therefrom, the root portion having a platform along an axis direction and a leaf spring installed on the platform, the leaf spring having one end fixed to the platform and the other end being a free end; and a supporting pole having a hollow cavity installed therein, the cavity having an opening at one end thereof, into which the root portion is inserted, a sliding groove disposed in the opening along an axis direction of the cavity, a sliding button embedded in the sliding groove, an elastic element installed in the sliding groove between the sliding button and the opening of the cavity, and an inner flange inward protruding from the opening of the cavity, allowing the free end of the leaf spring to be supported thereby.

2. The stick of claim 1, further comprising a protrusion disposed on the root portion, and a groove disposed on an inner side of the opening of the cavity and corresponding in position to the protrusion for the protrusion to be combined therewith, wherein the leaf spring corresponds in position to the sliding button.

3. The stick of claim 2, wherein the supporting pole combines with an umbrella that is received in the cavity.

4. The stick of claim 3, wherein the umbrella is a foldable umbrella that comprises a rib, a shaft, a handle having a tip cup connected to the shaft, a runner movable along the shaft and hinged on a side of the rib, and a canopy combined with one end of the rib and one end of the shaft, allowing the end of the rib, after retracted, to be received in the tip cup and enclose the shaft tightly, without enclosing a periphery of the runner.

5. The stick of claim 4, wherein the shaft comprises a plurality of retractable segments having cross sections decreasing toward the handle, allowing one of the retractable segments having a smallest cross section to be received in the tip cup of the handle, such that the end of the rib and the runner of the umbrella are receivable in the tip cup because the retractable segment that has the smallest cross section occupies a small space in the tip cup and a sidewall of the tip cup defines a large space in the tip cup.

6. The stick of claim 2, wherein the inner flange is conical.

7. The stick of claim 6, wherein the supporting pole combines with an umbrella that is received in the cavity.

8. The stick of claim 7, wherein the umbrella is a foldable umbrella that comprises a rib, a shaft, a handle having a tip cup connected to the shaft, a runner movable along the shaft and hinged on a side of the rib, and a canopy combined with one end of the rib and one end of the shaft, allowing the end of the rib, after retracted, to be received in the tip cup and enclose the shaft tightly, without enclosing a periphery of the runner.

9. The stick of claim 8, wherein the shaft comprises a plurality of retractable segments having cross sections decreasing toward the handle, allowing one of the retractable segments having a smallest cross section to be received in the tip cup of the handle, such that the end of the rib and the runner of the umbrella are receivable in the tip cup because the retractable segment that has the smallest cross section occupies a small space in the tip cup and a sidewall of the tip cup defines a large space in the tip cup.

10. The stick of claim 1, further comprising a seal ring disposed at a connection of the root portion with the grip element.

11. The stick of claim 1, wherein the supporting pole is retractable.

12. The stick of claim 11, wherein the supporting pole has a plurality of retractable skeleton segments, one of which has a plurality of locking holes disposed thereon, and another of which adjacent the one of the retractable skeleton segments has a depressible latch that matches with any one of the locking holes.

13. The stick of claim 12, wherein the supporting pole combines with an umbrella that is received in the cavity.

14. The stick of claim 13, wherein the umbrella is a foldable umbrella that comprises a rib, a shaft, a handle having a tip cup connected to the shaft, a runner movable along the shaft and hinged on a side of the rib, and a canopy combined with one end of the rib and one end of the shaft, allowing the end of the rib, after retracted, to be received in the tip cup and enclose the shaft tightly, without enclosing a periphery of the runner.

15. The stick of claim 14, wherein the shaft comprises a plurality of retractable segments having cross sections decreasing toward the handle, allowing one of the retractable segments having a smallest cross section to be received in the tip cup of the handle, such that the end of the rib and the runner of the umbrella are receivable in the tip cup because the retractable segment that has the smallest cross section occupies a small space in the tip cup and a sidewall of the tip cup defines a large space in the tip cup.

16. The stick of claim 1, wherein the supporting pole combines with an umbrella that is received in the cavity.

17. The stick of claim 16, wherein the umbrella is a foldable umbrella that comprises a rib, a shaft, a handle having a tip cup connected to the shaft, a runner movable along the shaft and hinged on a side of the rib, and a canopy combined with one end of the rib and one end of the shaft, allowing the end of the rib, after retracted, to be received in the tip cup and enclose the shaft tightly, without enclosing a periphery of the runner.

18. The stick of claim 17, wherein the shaft comprises a plurality of retractable segments having cross sections decreasing toward the handle, allowing one of the retractable segments having a smallest cross section to be received in the tip cup of the handle, such that the end of the rib and the runner of the umbrella are receivable in the tip cup because the retractable segment that has the smallest cross section occupies a small space in the tip cup and a sidewall of the tip cup defines a large space in the tip cup.

* * * * *